United States Patent [19]

Owens

[11] Patent Number: 4,752,156

[45] Date of Patent: Jun. 21, 1988

[54] LASER-GUIDED PORTABLE SCREED

[76] Inventor: Joe M. Owens, 842 Lake Holiday Dr., Sandwich, Ill. 60548

[21] Appl. No.: 6,895

[22] Filed: Jan. 27, 1987

[51] Int. Cl.[4] ..... E01C 19/35

[52] U.S. Cl. ..... 404/118; 404/120

[58] Field of Search ..... 404/84, 118, 120; 15/235.4

[56] References Cited

U.S. PATENT DOCUMENTS

| | | | |
|---|---|---|---|
| 2,796,685 | 6/1957 | Bensinger | 404/84 X |
| 3,069,983 | 12/1962 | Pizzarotti et al. | 404/84 X |
| 3,953,145 | 4/1976 | Teach | 404/84 |
| 4,371,287 | 2/1983 | Johanssen | 404/84 |
| 4,386,901 | 6/1983 | Morrison | 404/118 X |
| 4,665,633 | 4/1987 | Somero et al. | 404/118 X |

*Primary Examiner*—Jerome Massie
*Assistant Examiner*—Matthew Smith
*Attorney, Agent, or Firm*—Lee, Smith & Zickert

[57] ABSTRACT

A system for facilitating leveling of a screed as the screed is being drawn across freshly-poured concrete. The system includes a stationary signal transmitter which is separate from the screed and which generates a planar leveling signal. Mounted on the screed are a pair of leveling signal sensors, each of the sensors being equipped for generating an indication of the level of the screed after receipt of the leveling signal. The sensor are adjustably situated on the screed for proper adjustment and orientation toward the transmitter.

12 Claims, 2 Drawing Sheets

LASER-GUIDED PORTABLE SCREED

RELATED INVENTION

This application relates to portable screeds of the nature set forth in U.S. Pat. No. 4,591,291, issued May 27, 1986.

BACKGROUND OF THE INVENTION

This invention relates to concrete screeds and in particular to a portable screed which is guided by one or more operators to smooth freshly-poured concrete prior to finishing and curing.

As set forth in my U.S. Pat. No. 4,591,291, smoothing and leveling of freshly-poured concrete is done in essentially two ways. In a more automated manner, concrete screeds such as that described in my U.S. Pat. No. 4,340,351 are used. More traditionally, the concrete is manually leveled by two or more laborers by moving a board across the surface of the fresh concrete.

While either process results in relatively level concrete, modern-day tolerances require perfectly-leveled concrete within precise tolerances. Thus, sight levels, surveyors' levels, and other devices have been employed with some degree of accuracy. As allowable tolerances decreased, however, greater precision is demanded, and such means often are inadequate to assure proper concrete leveling.

SUMMARY OF THE INVENTION

The invention provides a system for facilitating leveling of a concrete screed while the screed is passing across the surface of the concrete during the smoothing operation. Included is a stationary signal transmitter separate from the screed, the transmitter having means for generating a planar leveling signal throughout an angular reference plane. Means for receiving the leveling signal is located on and travels with the screed. The receiving means also includes means for generating an indication of the level of the screed after receipt of the leveling signal. The receiving means is also adjustably situated on the screed for appropriate adjustment and orientation toward the signal transmitter.

Ordinarily, in order to assure the level of the screed, the receiving means is composed of a pair of spaced signal sensors located toward opposite ends of the screed. Each of the sensors is secured to the screed by a mounting assembly, the mounting assembly itself being secured to a post that is attached to the screed. In accordance with the illustrated embodiment of the invention, the mounting assembly comprises an upstanding pin on the post and a pivotal support encompassing the pin, with each sensor being secured to its respective support, and including a thumb screw for locking the support to the pin.

In accordance with the described embodiment of the invention, the support comprises a vertical column which encompasses the pin and a bracket mounted for vertical movement on the column, with a thumb screw being provided for locking the bracket to the column. The sensor is secured to the bracket for adjustment therewith. For ease of use by the operator of the screed, a remote display of the level is mounted on a separate arm and is pivotally adjustable to be in proper view of the operator. Each of the signal sensors also normally includes a level display.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
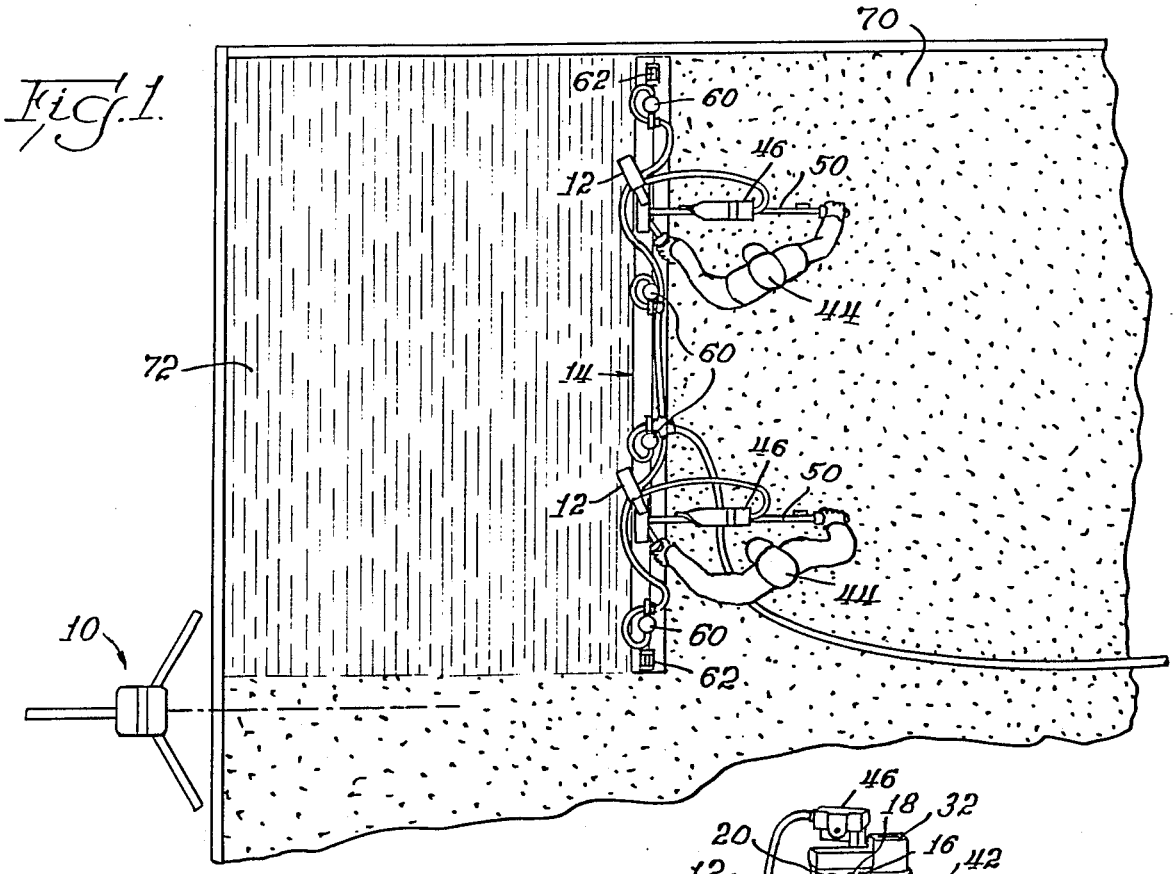
FIG. 1 is a top view of the invention when employed in the process of smoothing freshly-poured concrete.

The invention is illustrated in the drawing figures, and consists of two primary components, a stationary signal transmitter 10 and one or more signal sensor 12 mounted on a portable screed 14. The signal transmitter 10 is stationary and separate from the screed 14, while the sensors 12 are adjustably mounted on the screed 14 and travel with the screed 14 as concrete is smoothed.

The signal transmitter 10 may be any conventionally manufactured transmitter, such as a laser transmitter which generates a planar leveling signal throughout a 360° reference plane. One example of such a signal transmitter is the CLS Super Mite Electronic Level, manufactured by CLS Industries, Inc., Hawthorne, Calif. 90250. Other companies manufacture similar devices.

The signal sensors 12 may also be conventional, and are adapted for receipt of the laser leveling signal generated by the signal transmitter 10. A suitable such sensor is the Accusensor Detector manufactured again by CLS Industries, Inc., and used in combination with the CLS Super Mite. Other manufacturer's sensors, currently available and used for stationary leveling purposes, may also be employed.

Normally, a pair of signal sensors 12 must be employed in combination with the screed 14. Were only one sensor 12 employed, the level of the screed could not be assured since only the elevation of the screed at the location of the sensor would be assured. The ends of the screed 14, when using only a single sensor 12, could be well out of height alignment, and therefore out of level.

Figure 5:
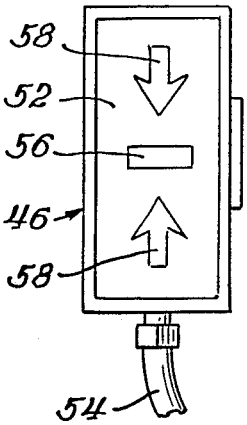
FIG. 5 is a further enlarged view of the display portion of the remote display.

Each of the signal sensors 12 includes an inlet slot 16 for receiving a signal from the signal transmitter 10. The relative level of the screed 14 at the location of the sensor 12 is indicated on a display 18, configured much the same as the display of FIG. 5, described below. An adjustment knob 20 is used for initial fine adjustment of the level on the display 18, and if desired, an audio signal of the level can also be generated by the sensor 12 from the speaker 22.

Figure 2:
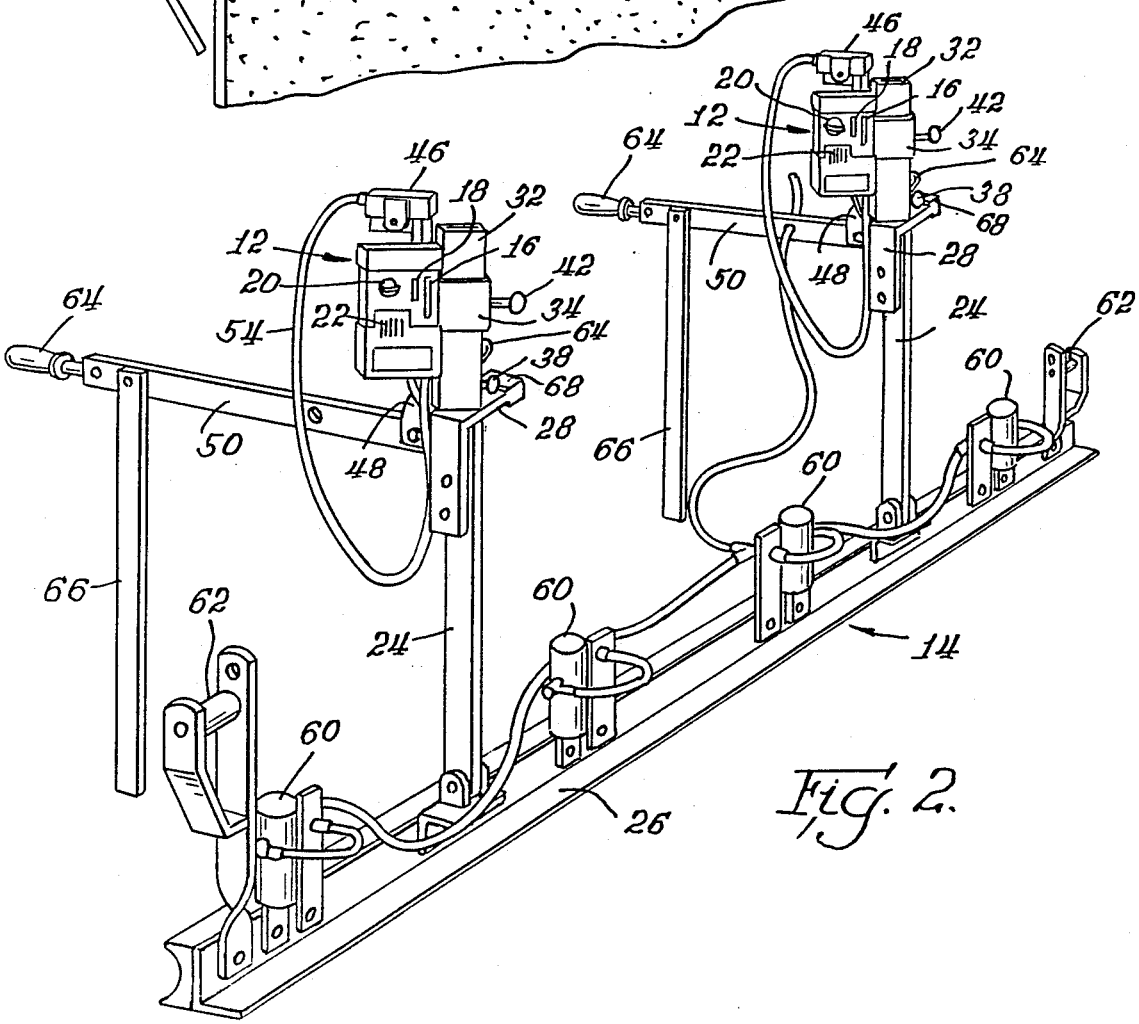
FIG. 2 is a perspective view of a portable screed having the associated signal sensors of the invention mounted thereon, but omitting the signal transmitter.
Figure 6:
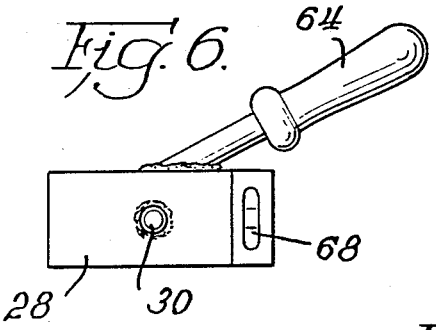
FIG. 6 is a top plan view of a first portion of the mounting assembly for the signal sensor.
Figure 7:
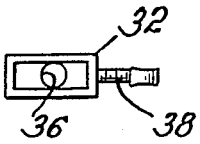
FIG. 7 is a top plan view of second portion of the mounting assembly for the signal sensor.
Figure 8:
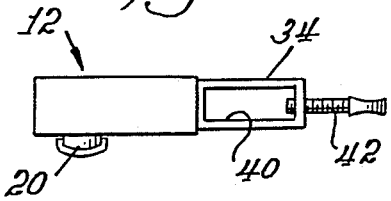
FIG. 8 is a top plan view of a third portion of the mounting assembly for the signal sensor, and including the sensor attached thereto.
Figure 9:
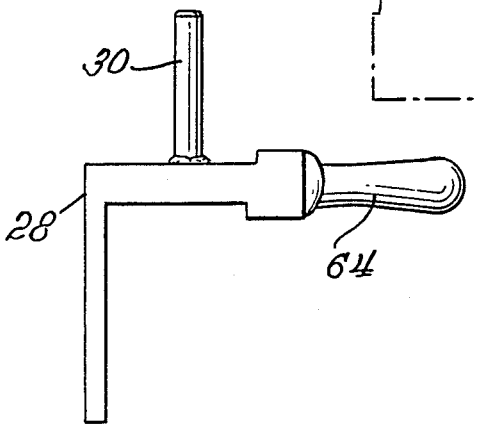
FIG. 9 is a front elevational view of the portion of the mounting assembly illustrated in FIG. 6.
Figure 10:
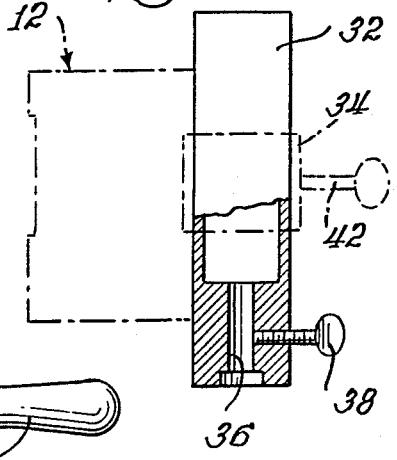
FIG. 10 is an elevational view of the second portion of the mounting assembly shown in FIG. 7, with the addition of a thumb screw and illustrating the adjustability thereof.
Figure 11:
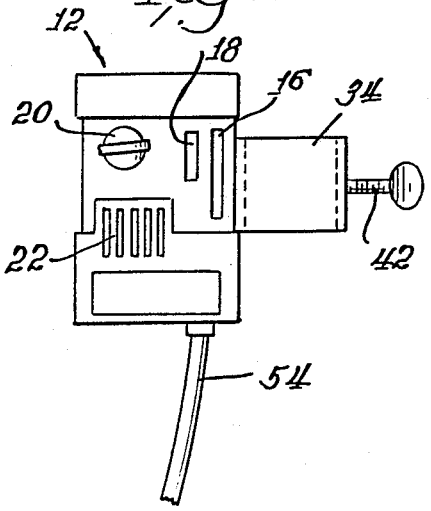
FIG. 11 is an elevational view of the third portion of the mounting assembly shown in FIG. 8, including the signal sensor mounted thereon.

Each of the sensors 12 is adjustably situated on the screed 14. As best illustrated in FIG. 2, a pair of pivotal post 24 are secured to the top of the screed plate 26 of the screed 14, and are topped by a mounting assembly composed of an L-shaped bracket 28, an upstanding pin 30 (FIGS. 6 and 9) permanently secured to the horizontal leg of the bracket 28, and a pivotal support encompassing the pin 30 and composed of a vertical column 32 and a corresponding rectangular bracket 34 mounted for vertical movement on the column 32. As seen in FIGS. 7 and 10, the column 32 is rectangular in cross section, is hollow at its upper reaches, and includes an internal bore 36 to accommodate the pin 30. While the column 32 is freely rotatable on the pin 30, for fixing the column 34 in place, a thumb screw 38 is employed, threadedly secured in a horizontal aperture in the column 32 and extending to the bore 36. By utilization of the thumb screw 38, the column 32 can be prevented from rotation on the pin 30, and can also be raised or lowered to a desired elevation on the pin 30.

The rectangular bracket 34 has a hollow inner aperture 40 shaped to accommodate the column 32. For securing of the bracket 34 on the column 32, a thumb screw 42 is employed, threadedly installed within a bore in the bracket 34. As shown in phantom in FIG. 10, the bracket 34 may therefore be raised or lowered as desired along the column 32.

The sensor 12 is appropriately secured to the bracket 34 (means not illustrated). Therefore, vertical orientation of the sensor 12 with respect to the screed plate 26 can readily be adjusted within the limits of the height of the column 32.

Figure 3:
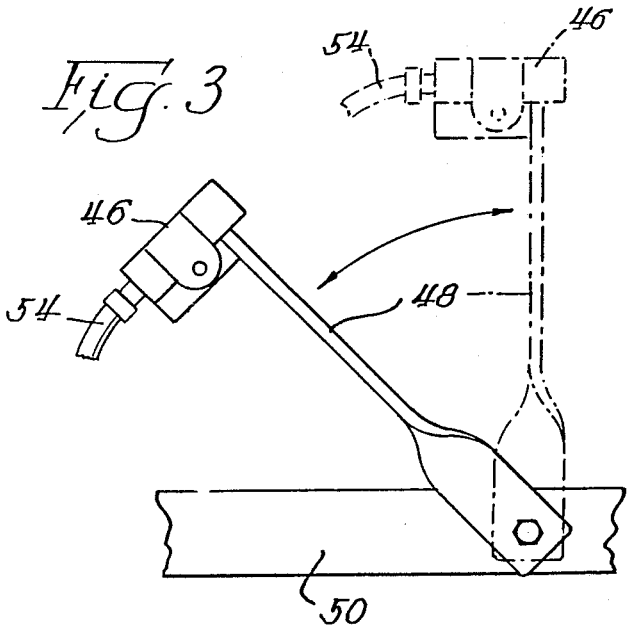
FIG. 3 is an enlarged side view of the remote display, including, in phantom, a second position for the display.
Figure 4:
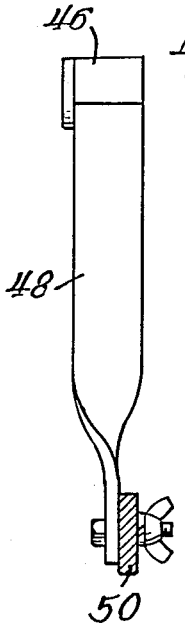
FIG. 4 is an elevational view of the display of FIG. 3 when in the fully upright orientation.

As shown in FIG. 1, an operator 44 for the screed 14 stands behind the screed 14 and often behind the display 18 of the sensor 12. Therefore a remote display 46 is also employed, separately mounted upon an arm 48 pivotally secured to a horizontal leg 50 affixed to each of the vertical post 24. As best shown in FIG. 3, each arm 48 may be pivoted between an upright orientation shown in phantom and an essentially horizontal orientation, thus permitting ready adjustment for view by the operator 44.

Each remote display 46 includes a display screen 52 and is electrically connected to an associated sensor 12 by means of a cable 54. The screed 52 includes an electrical level indicator 56 which travels between arrows 58, depending on the level of the screed 14.

The screed 14 illustrated is a model WXL-500 Wet Screed, manufactured by Owens Industries, Sandwich, Ill. 60548. Besides the screed plate 26, posts 24 and legs 50, the screed 14 also includes a series of interconnected air vibrators 60, end lift handles 62, and grips 64 for the operator 44, one grip for each operator 44 being secured to the leg 50 and the other grip 64 being secured to the bracket 28. Supports 66 hingedly affixed to the legs 50 are used to rest the screed in the upright orientation shown in FIG. 2 when the grips 64 are not being held by the operator 44. In addition, a sight level 68 may be included on the horizontal leg of each of the L-shaped brackets 28, as shown in FIG. 6.

For assembly of the sensors 12 and associated mounting assemblies, the brackets 28 are first secured to the associated post 24. Thereafter, the column 32 is installed over the pin 30 and the bracket 34, with sensor 12 attached, is slipped onto the column 32.

In use, the screed 14 is drawn rearwardly by the operators 44 across an area of poured concrete 70, leaving a screeded surface 72. Initially, before screeding is begun, the signal transmitter 10 is situated at a desired location and its leveling signal is initiated. With the screed 14 in place on the concrete 70 and properly initially leveled, the sensors 12 are adjusted to receive the planar leveling signal from the transmitter 10, with the indicator 56 of the remote display 46 equi-distant between the two arrows 58. As screeding commences, the operators 44 view the level indicator of the remote display 46. If the indicator 56 migrates toward one or the other of the arrows 58, each operator 44 knows to either raise or lower the screed 14, as appropriate, to maintain the proper level of the screeded surface 72. Therefore, so long as the leveling signal from the transmitter 10 remains precisely level, the screeded surface 72 can be maintained to close tolerances without constantly requiring interruption of the screeding process and manually determining the level of the concrete surface 72. Also, it is quite evident that the concrete 70 can be screeded without the necessity of containing forms, greatly accelerating the process of screeding large areas of concrete, and commensurately reducing labor and costs.

A typical signal transmitter 10 generates its laser signal throughout a 360° reference plane. If desired or possible, it is evident that the entire reference plane is unnecessary, and only a relatively small sector is required for line of sight alignment of the transmitter 10 and the sensors 12 as the screed 14 is translated across the surface of the concrete 70.

Various changes can be made to the invention without departing from the spirit thereof or scope of the following claims.

What is claimed is:

1. In combination with a portable screed for working concrete, the screed being manually operated by an operator who physically guides the screed over an area of freshly poured concrete and having an elongated screed plate for resting upon and working concrete as the screed is drawn across the surface of the concrete, a system for facilitating manual leveling of the screed by the operator by physically raising and lowering the screed while the screed is in motion, comprising a. a stationary signal transmitter separate from the screed, said transmitter including means for generating a planar leveling signal throughout an angular reference plane, b. means on and traveling with said screed for receiving said leveling signal, said receiving means further including means visible to the operator when operating the screed for generating an indication of the level of the screed after receipt of said leveling signal, and c. means adjustably situating said receiving means on said screed, d. screed guiding means comprising a pair of grips and means securing said grips to said screed, one grip being located proximate to and substantially vertically above said screed plate and the other grip being substantially vertically above and spaced laterally outwardly from said screed plate and said one grip, said screed, in combination with said receiving means, being light weight such that the operator may physically raise and lower the screed with said grips while working concrete in order to maintain said receiving means in alignment with said planar leveling signal.

2. A leveling system according to claim 1 in which said receiving means comprises a pair of spaced signal sensors.

3. A leveling system according to claim 1 in which said situating means comprises a mounting assembly, said mounting assembly being secured to a post attached to said screed plate.

4. A leveling system according to claim 3 in which said mounting assembly comprises an upstanding pin on said post and a pivotal support encompassing said pin, said receiving means being secured to said support, and including means for locking said support to said pin.

5. A leveling system according to claim 4 in which said support comprises a vertical column encompassing said pin and a bracket mounted for vertical movement on said column, said receiving means being secured to said bracket, and including means for locking said bracket on said column.

6. A leveling system according to claim 5 in which each said locking means comprises a thumb screw.

7. A leveling system according to claim 5 in which said column is rectangular and includes an internal guide shaped to accommodate said pin.

8. A leveling system according to claim 1 in which said means for generating an indication includes a remote display, and including separate means for mounting said remote display on said screed.

9. A leveling system according to claim 8 in which said separate mounting means comprises an arm having opposite ends, one end of said arm being pivotally secured to said screed and said remote display being secured to the other end of said arm.

10. In combination with a portable screed for working concrete, the screed being manually operated by an operator who physically guides the screed over an area of freshly poured concrete and having an elongated screed plate for resting upon and working concrete as the screed is drawn across the surface of the concrete, a system for facilitating manual leveling of the screed by the operator by physically raising and lowering the screed while the screed is in motion, comprising a. a stationary signal transmitter separate from the screed, said transmitter including means for generating a planar leveling signal throughout an angular reference plane, b. a pair of spaced sensors on and traveling with said screed, said signal sensors including means for receiving said leveling signal, said receiving means further including means visible to the operator when operating the screed for generating an indication of the level of the screed after receipt of the leveling signal, c. a pair of spaced upright posts attached to said screed, each of said posts being adapted for mounting one of said signal sensors and d. an adjustable mounting assembly on each post for mounting a said signal sensor, said mounting assembly including a vertical pin and pivotal support encompassing said pin, e. screed guiding means comprising a pair of grips and means securing said grips to said screed, one grip being located proximate to and substantially vertically above said screed plate and the other grip being substantially vertically above and spaced laterally outwardly from said screed plate and said one grip, said screed, in combination with said receiving means, being light weight such that the operator may physically raise and lower the screed with said grips while working concrete in order to maintain said receiving means in alignment with said planar leveling signal.

11. A leveling system according to claim 10 in which said support comprises a vertical column encompassing said pin and a bracket mounted for vertical movement on said column, said receiving means being secured to said bracket, and including means for locking said bracket on said column.

12. A leveling system according to claim 11 in which said locking means comprises a thumb screw.

* * * * *